US008991092B2

(12) United States Patent
Shipman et al.

(10) Patent No.: US 8,991,092 B2
(45) Date of Patent: Mar. 31, 2015

(54) METHOD AND APPARATUS FOR SPLITTING A DELTA RING ON A RIFLE

(75) Inventors: Kel Shipman, Canandaigua, NY (US); Robert Ryan, Camillus, NY (US); Steven C. Buxton, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 244 days.

(21) Appl. No.: 13/570,821

(22) Filed: Aug. 9, 2012

(65) Prior Publication Data

US 2013/0036648 A1 Feb. 14, 2013

Related U.S. Application Data

(60) Provisional application No. 61/522,524, filed on Aug. 11, 2011.

(51) Int. Cl.
*F41C 27/00* (2006.01)
*F41C 23/16* (2006.01)

(52) U.S. Cl.
CPC ..... *F41C 27/00* (2013.01); *F41C 23/16* (2013.01)
USPC ..... 42/108; 42/90; 42/106

(58) Field of Classification Search
USPC ..... 42/108; 86/561, 452, 145
See application file for complete search history.

(56) References Cited

U.S. PATENT DOCUMENTS

| | | | | | |
|---|---|---|---|---|---|
| 326,327 | A * | 9/1885 | Pickett | ..... | 30/183 |
| 2,608,748 | A * | 9/1952 | Kirkwood | ..... | 30/124 |
| 3,057,232 | A * | 10/1962 | Cornell, Jr. | ..... | 30/90.1 |
| 8,302,519 | B2 * | 11/2012 | McCracken et al. | ..... | 83/473 |

* cited by examiner

*Primary Examiner* — Troy Chambers
*Assistant Examiner* — Bridget Cochran
(74) *Attorney, Agent, or Firm* — Harris Beach PLLC

(57) ABSTRACT

An apparatus comprising a tool body having parallel columns extending from a common base. The base includes a lip extending outward from the columns defining an anvil for receiving a delta ring. A cutter has a body slidably disposed between the columns. A blade extends outward from the cutter body in opposition to the anvil and is aligned by transverse guide pins extending through guide slots in the columns. In operation, a section of the delta ring is positioned between the blade and the anvil. The blade is driven toward the anvil by any of various mechanical, pneumatic, and/or hydraulic mechanisms connected to the stanchion and blade, the simplest of which is a bolt extending through the cutter body and received in a threaded bore in the base. Preferably, the anvil includes a slot for receiving the blade at the extreme of its travel as the ring is severed.

13 Claims, 6 Drawing Sheets

METHOD AND APPARATUS FOR SPLITTING A DELTA RING ON A RIFLE

The present application draws priority from a U.S. Provisional Patent Application, Ser. No. 61/522,524, filed Aug. 11, 2011.

TECHNICAL FIELD

The present invention relates to military-style small arms and modern sporting rifles that are fashioned after an AR15 style of fire arm having a similar form of handguard system; more particularly, to the "delta ring" component of an AR15 type rifle such as an M16 or M4 carbine rifle; and most particularly, to an apparatus and method for use in splitting a delta ring installed on a rifle to facilitate, for example, changing of a type of handguard or converting to a free-float barrel.

BACKGROUND OF THE INVENTION

A so-called delta ring is a well known inline component of various types of shoulder-fired weapons also known in the art as long arms. In an assembled weapon, the delta ring assembly consists of an aluminum alloy delta ring, a steel weld bias spring and a snap ring that retains the assembly on the barrel assembly. The delta ring surrounds a proximal portion of the weapon barrel and is spring-biased forward by the steel weld spring to retain, support, and position a two-piece handguard assembly on and around the barrel. The delta ring may be urged manually rearward of the barrel against the bias spring to free each upper and lower handguard section for removal.

Typically, a delta ring assembly may be thought of as a sub-assembly of the barrel assembly and integral to the handguard system. For various reasons that may arise during use of a long arm, it may become desirable to remove the delta ring assembly rapidly and easily, for example, as a step in changing over to a new and/or different type of handguard system which might substantially improve the performance of the long arm such as by allowing the barrel to free float. After the weapon's handguard is removed, the delta ring is fully exposed and accessible.

In the prior art, the delta ring is removed either by a full disassembly of the barrel from the upper receiver by removal of the handguard, then the gas tube, and then the barrel nut. Alternatively, the delta ring may be removed by removing the handguard and then splitting the delta ring in two with, for example, general purpose tools such as large bolt cutters or a Dremel cutting tool, and then removing the two halves of the delta ring radially of the weapon.

Dissassembly by removing the barrel nut is generally undesirable as it is time-consuming and requires a pin punch to remove the gas tube retaining pin, removal of the gas tube, a special barrel nut tool to remove the barrel nut from the weapon's upper receiver and requires snap ring pliers to release the delta ring assembly, sliding the delta ring, steel weld spring, and snap ring off the distal end of the barrel. Reassembly of the barrel assembly after removing the delta ring assembly requires re-torquing the barrel nut back onto the receiver which is more time-consuming and requires both a barrel nut tool and a torque wrench and is generally undesirable to perform more times than is necessary as one is torqing a steel nut onto aluminum threads which are softer and may wear or fatigue. Furthermore, force is applied to the barrel nut in the torquing process which acts upon the thin crenellations of the barrel nut which encircle the gas tube after final installation. This force on the barrel nut tool can deform the barrel nut crenellations and consequently require replacement of the barrel nut altogether. This may also be difficult to accomplish under field conditions and can expose the weapon to misaligning forces during reassembly.

Splitting the delta ring is generally a preferable method of removal of the delta ring assembly, as it exposes the weld spring and snap ring for easy removal from the proximal end of the barrel with general purpose pliers; however, current methods for cutting the delta ring itself using electrically-powered tools, which may not be present under field conditions, require more skill and may also nick the barrel nut or receiver, and may require several cutting blades. In methods using large bolt cutters, the tool may easily slip off the delta ring and may require an additional fixture to secure the upper receiver or barrel during the operation.

What is needed in the art is a method for splitting a delta ring using a simple and lightweight apparatus that may be readily available in the field and can reduce the training or skill required to complete the task.

It is a principal object of the present invention to facilitate removal of a delta ring assembly from a weapon.

SUMMARY OF THE INVENTION

Briefly described, a currently preferred apparatus in accordance with the present invention includes a tool body having first and second spaced-apart parallel columns extending from a common base. The base includes a lip generally perpendicular to the columns and extending outward therefrom, preferably with ears, defining an anvil for receiving a delta ring. A guillotine cutter has a cutter body slidably disposed between the columns and a blade extending outward from the columns and positioned facing and in opposition to the anvil. The cutter body is aligned during travel between the columns by one or more transverse guide pins extending through guide slots formed in the columns.

In operation, a section of the delta ring is positioned between the blade and the anvil, following which the blade is driven toward the anvil by any one of various mechanical, pneumatic, and/or hydraulic mechanisms known in the art and connected to the tool body and cutter body, the simplest of which is a bolt extending through the cutter body and received in a threaded bore in the base or vice versa. Preferably, the anvil includes a slot for receiving the blade at the extreme of its travel, as the ring is severed.

Other embodiments may include, for example, two such tools, which may be operationally connected for cutting simultaneously two diametrically opposed delta ring sections.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
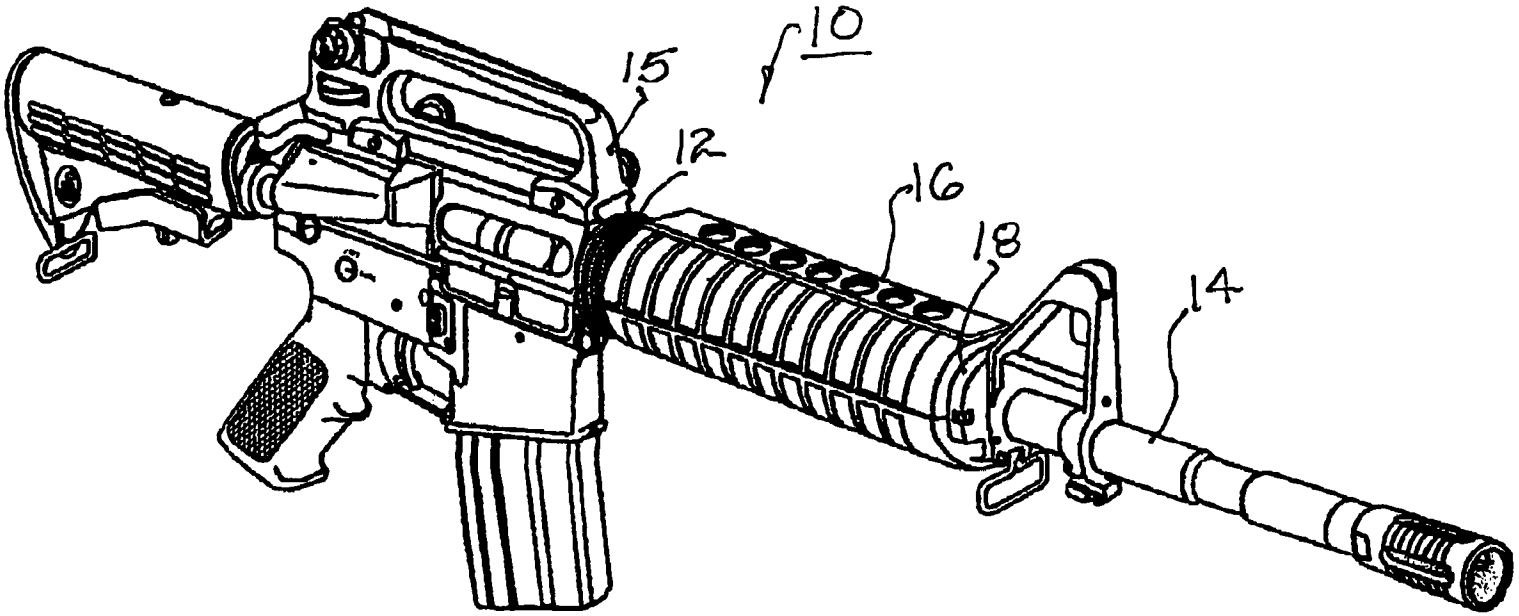
FIG. 1 (PRIOR ART)
FIG. 1 is an isometric view of a prior art M4A3 carbine rifle having a delta ring and removable handguard.
Figure 2:
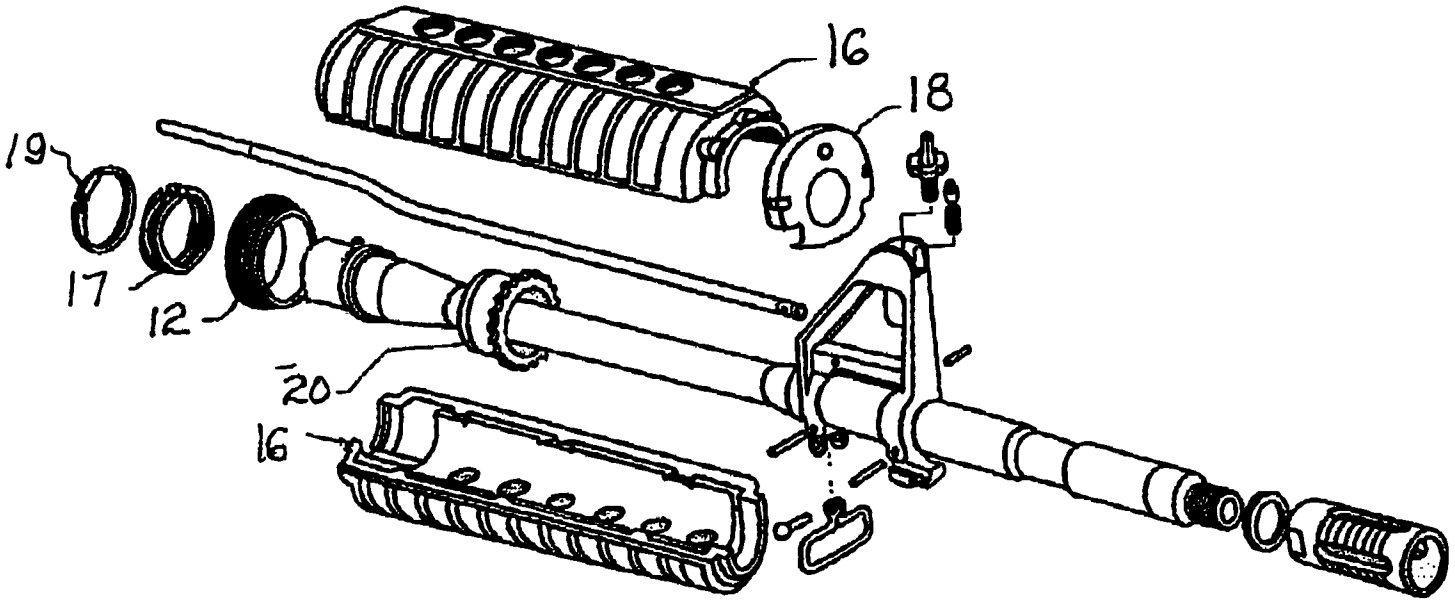
FIG. 2 (PRIOR ART)
FIG. 2 is an exploded isometric view of the barrel assembly of the rifle shown in FIG. 1.

Referring to FIGS. 1 and 2, a typical AR15 military-style rifle 10 having a delta ring 12 is shown. Delta ring 12 is slidably disposed on barrel 14 and is spring-biased forward to engage and retain split handguard 16 in use position by urging the handguard into reception by handguard cap 18. When delta ring 12 is displaced away from handguard 16 by compressing weld spring 17 against spring clip 19, the handguard is readily removed, providing full axial access to delta ring 12 and scalloped barrel nut 20 which is threaded and torqued onto receiver 15.

Figure 3:
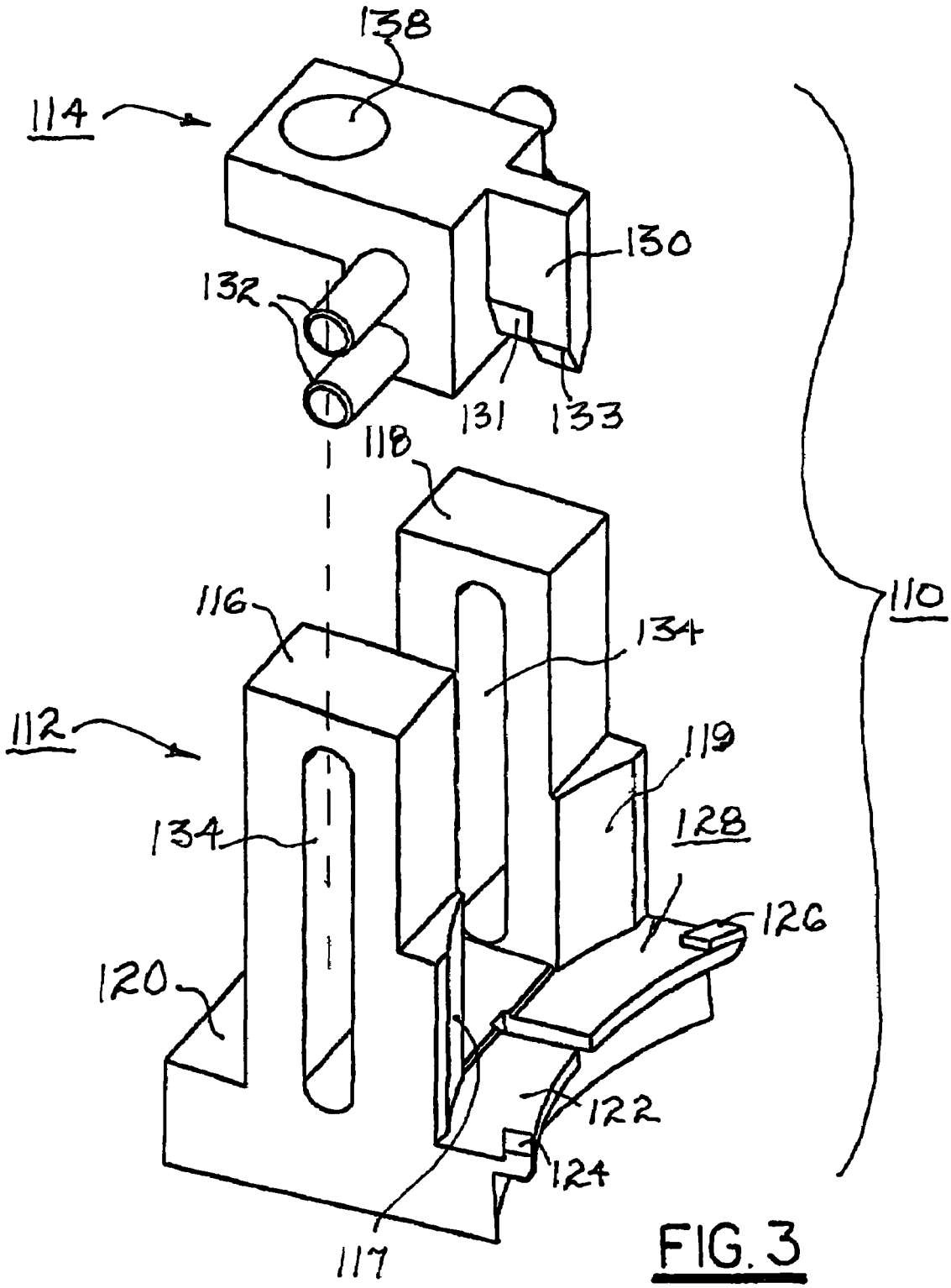
FIG. 3 is an exploded isometric drawing of a portion of a first embodiment of a delta ring splitting apparatus in accordance with the present invention.
Figure 5:
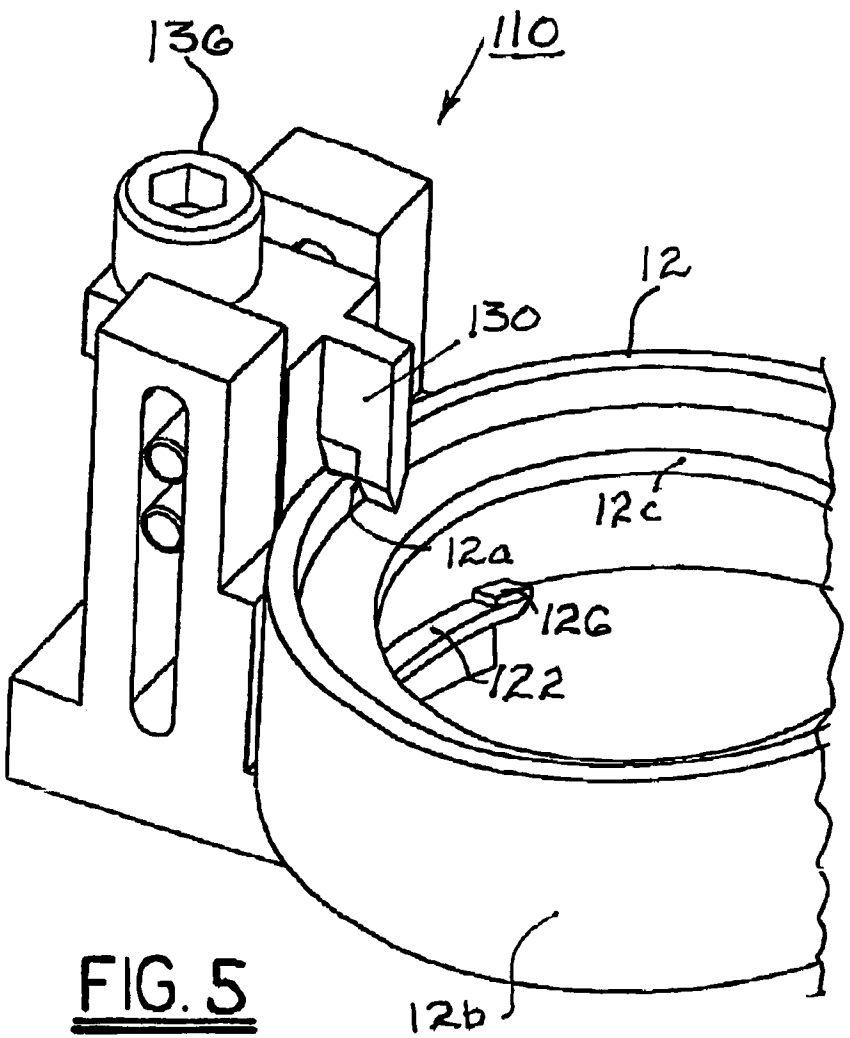
FIG. 5 is an isometric view of the apparatus shown in FIG. 4 having a delta ring installed in position for splitting in accordance with a method of the present invention.
Figure 4:
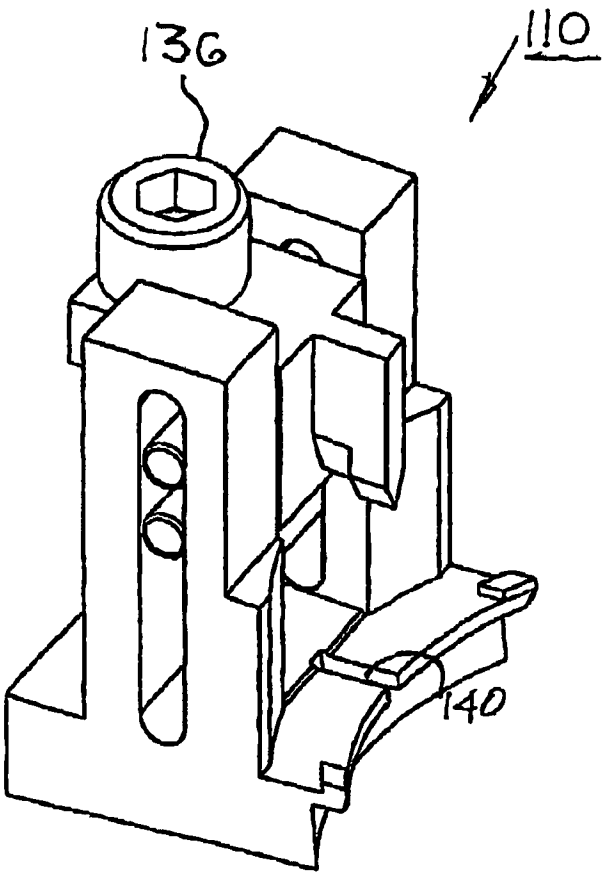
FIG. 4 is an isometric view of a completely assembled apparatus in accordance with the present invention.

Referring to FIGS. 3 through 5, a first embodiment 110 of a tool for splitting a delta ring comprises a tool body 112 and a cutter body 114, both formed preferably of metal alloys such as steel, and hardened steel for the blade.

Tool body 112 comprises first and second spaced-apart parallel columns 116,118 extending from a common base 120. Base 120 includes a lip 122 generally perpendicular to columns 116,118 and extending outward therefrom, preferably with first and second hooks 124,126, defining an anvil 128 for receiving a delta ring 129 on lip 122 behind hooks 124,126. Columns 116,118 preferably are provided with respective arcuate surfaces 117,119 that are conformable with the outer surface of a delta ring.

Cutter body 114 is slidably disposed between columns 116,118, and blade 130 extends outward from columns 116, 118 and is positioned facing and in opposition to anvil 128. Cutter body 114 is aligned during travel between columns 116,118 by one or more transverse guide pins 132 mounted in cutter body 114 and extending through guide slots 134 formed in columns 116,118.

In operation of the present example, a portion 12*a* of delta ring 12 is positioned between blade 130 and anvil 128, following which blade 130 is driven toward anvil 128 by machine bolt 136 extending through a smooth bore 138 in cutter body 114 and received in a threaded bore (not visible) in base 120. Preferably, anvil 128 includes a slot 140 for receiving blade 130 at the extreme of its travel, as delta ring 12 is severed.

A delta ring 12 typically includes a tapered body portion 12*b* and an inner ring 12*c* for engaging a flange on handguard 16. Therefore, preferably blade 130 comprises first and second blade edges 131,133 for cutting body portion 12*b* and inner ring 12*c*, respectively. The inner edge of second blade edge 133 also keeps first blade edge 131 retained in tapered surface 12*b* while it is cutting.

Figure 6:
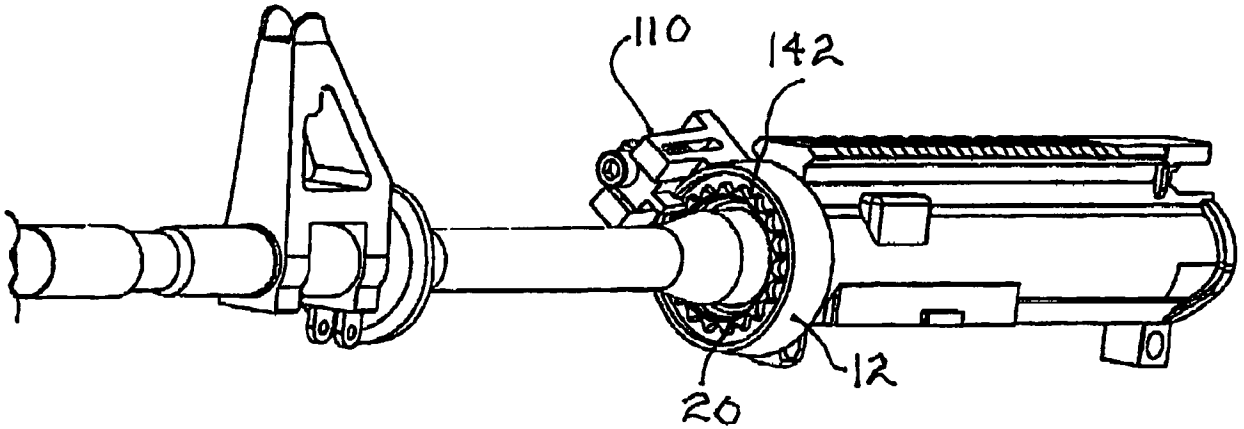
FIG. 6 is an isometric view showing the apparatus shown in FIG. 4 disposed on the barrel assembly shown in FIG. 2.
Figure 7:
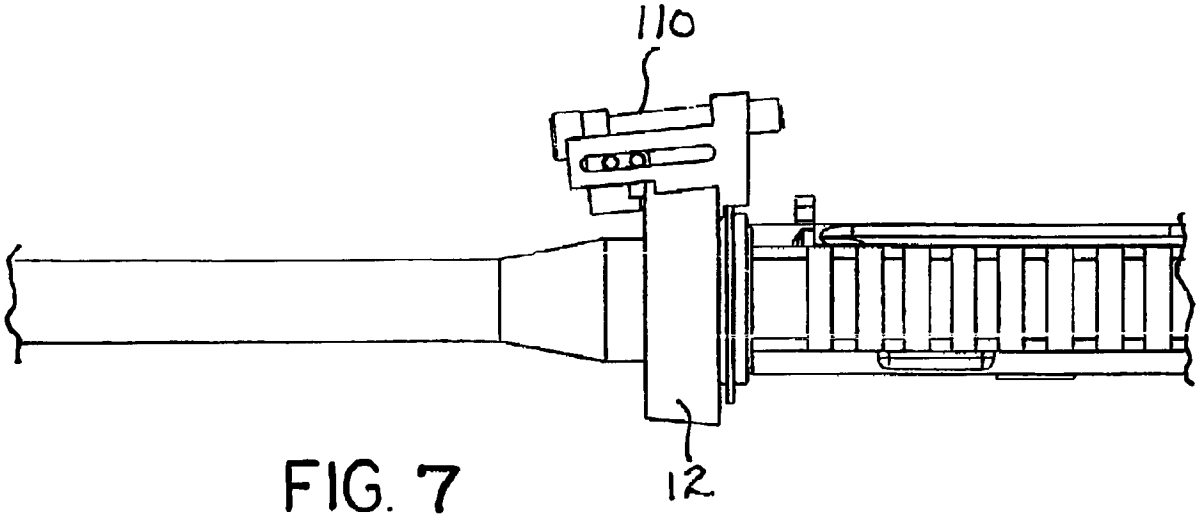
FIG. 7 is an elevational view similar to the isometric view shown in FIG. 6.
Figure 8:
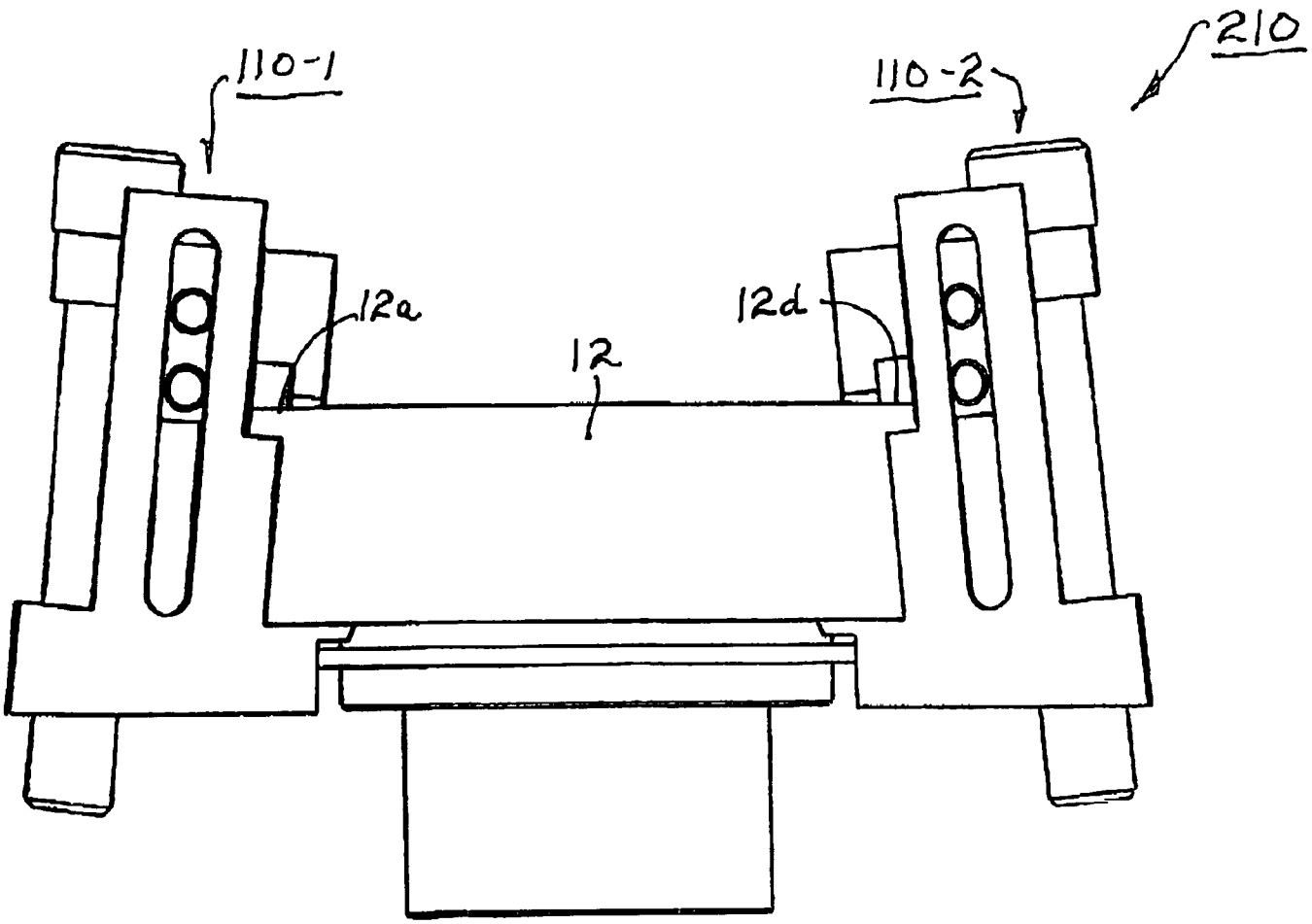
FIG. 8 is an elevational view showing a second embodiment of a delta ring splitting apparatus wherein first and second splitters are disposed in opposition on a common delta ring.

Referring to FIGS. 6 and 7, after handguard 16 (FIG. 2) is removed, tool 110 may be installed onto delta ring 12. Note that blade 130 is formed to fit through the crenellations 142 on barrel nut 20.

Other embodiments of the present invention may include, for example, a second embodiment 210 comprising two such tools 110-1,110-2 to be used simultaneously and operationally connected (not shown) for cutting two diametrically opposed sections 12*a*,12*d* of delta ring 12. Such operationally connected means (not shown) may be mechanical, hydraulic, and/or pneumatic and may include, for example, a lever and/or a ratchet.

Another embodiment (not shown) envisioned by the present invention comprises a tool wherein first and second blades ("upper" and "lower" blades, respectively) engage a delta ring therebetween and are driven towards each other in the manner of a bolt cutter. Preferably, each blade includes a hook-like feature to maintain the delta ring in proper position during cutting thereof.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A tool for splitting a delta ring on a rifle, comprising:

a tool body having a base;

first and second spaced apart columns extending from said base;

a lip extending from said base defining an anvil adapted to receive a first portion of said delta ring exposed by removal of a handguard of said rifle;

a cutter body slidingly disposed between said columns and having a blade extending in opposition to said anvil; and, a machine bolt that extends through a smooth bore in said cutter body, said machine bolt threadingly coupled to said tool body to drive said cutter body and said blade toward a side of said delta ring so as to split said delta ring to remove said delta ring from said rifle.

2. A tool in accordance with claim 1 further comprising:

opposed first and second guide slots in said first and second columns, respectively; and at least one guide pin extending through said cutter body into said first and second guide slots.

3. A tool in accordance with claim 1 further comprising at least one hook extending orthogonal to said lip to engage said delta ring.

4. A tool in accordance with claim 1 wherein said tool body is formed of a metal alloy.

5. A tool in accordance with claim 1 wherein said blade is formed of a metal alloy.

6. A tool in accordance with claim 1 wherein said blade comprises a first blade edge and a second blade edge.

7. A tool in accordance with claim 1 wherein at least one face on each of said columns is formed to conform with an outer surface of said delta ring.

8. A tool in accordance with claim 1 wherein said anvil includes a groove to receive said blade.

9. A tool in accordance with claim 1, wherein said tool body and columns, said cutter body and blade, and said anvil collectively define a first cutting tool, further comprising a second cutting tool substantially identical with said first cutting tool and mountable onto a second portion of said delta ring.

10. A tool in accordance with claim 9 wherein said first and second cutting tools share a common mechanism to drive said first and second cutter bodies and blades toward respective of said first and second anvils.

11. A tool in accordance with claim 9 wherein said first and second portions of said delta ring are about diametrically opposed in said delta ring.

12. A method for splitting a delta ring mounted on a rifle, comprising the steps of:

providing a cutting tool having a tool body and a tool body base, first and second spaced apart columns extending from said base, a lip extending from said base defining an anvil, a cutter body slidingly disposed between said columns and having a blade extending in opposition to said anvil, and a machine bolt that extends through a smooth bore in said cutter body, said machine bolt threadingly coupled to said tool body to drive said cutter body and said blade toward a side of said delta ring so as to split said delta ring for removal;

retracting said delta ring from an associated handguard on said rifle;

removing said handguard from said rifle to fully expose said delta ring;

attaching said cutting tool to said delta ring by engaging a portion of said delta ring between said anvil and said blade; and energizing said mechanism to drive said blade through said delta ring toward said anvil.

13. A tool in accordance with claim 6 further comprising a hook-like feature on at least one of said first and second blades to maintain said delta ring in proper position during cutting thereof.

* * * * *